US011531304B2

(12) United States Patent
Hernandez et al.

(10) Patent No.: US 11,531,304 B2
(45) Date of Patent: Dec. 20, 2022

(54) TIMEPIECE BALANCE

(71) Applicant: Nivarox-FAR S.A., Le Locle (CH)

(72) Inventors: Ivan Hernandez, Cressier (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 266 days.

(21) Appl. No.: 16/829,053

(22) Filed: Mar. 25, 2020

(65) Prior Publication Data

US 2020/0356055 A1 Nov. 12, 2020

(30) Foreign Application Priority Data

May 7, 2019 (EP) ..... 19173069

(51) Int. Cl.

| | |
|---|---|
| ***G04B 18/04*** | (2006.01) |
| ***G04B 17/06*** | (2006.01) |
| ***G04B 18/00*** | (2006.01) |
| ***G04B 18/08*** | (2006.01) |

(52) U.S. Cl.

CPC ..... *G04B 17/063* (2013.01); *G04B 18/006* (2013.01); *G04B 18/04* (2013.01); *G04B 18/08* (2013.01)

(58) Field of Classification Search

CPC ..... G04B 18/006; G04B 17/32; G04B 18/08; G04B 17/063; G04B 18/04

See application file for complete search history.

(56) References Cited

U.S. PATENT DOCUMENTS

| | | | | |
|---|---|---|---|---|
| D700,535 | S * | 3/2014 | Graf | D10/128 |
| D730,764 | S * | 6/2015 | Graf | D10/128 |
| 9,547,278 | B2 | 1/2017 | Graf et al. | |
| 10,061,269 | B2 * | 8/2018 | Graf | G04B 18/06 |

(Continued)

FOREIGN PATENT DOCUMENTS

| | | |
|---|---|---|
| CH | 698 024 B1 | 4/2009 |
| CH | 705 238 A2 | 1/2013 |

(Continued)

OTHER PUBLICATIONS

European Search Report dated Oct. 15, 2019 in European Application 19173069.6 filed on May 7, 2019 (with English Translation of Categories of cited documents), 3 pages.

(Continued)

*Primary Examiner* — Sean Kayes

(74) *Attorney, Agent, or Firm* — Oblon, McClelland, Maier & Neustadt, L.L.P.

(57) ABSTRACT

A balance for a horological movement, including rigid parts constituted by a hub defining the pivot axis of the balance, at least one felloe sector, at least one arm connecting the at least one felloe sector to said hub, and including a slot for receiving and gripping in position an inertia-block, the slot opening into a housing delimited on the one hand by a rigid part of the balance, and on the other hand an elastic arm including a first end integral with a rigid part of the balance, and a second free distal end. The elastic arm can have a body of a non-constant section, a part of the body having a greater thickness than the rest of the elastic arm so as to have a larger volume of material under stress and store a maximum of elastic energy.

17 Claims, 2 Drawing Sheets

(56) References Cited

U.S. PATENT DOCUMENTS

| | | | | |
|---|---|---|---|---|
| 2015/0253733 | A1* | 9/2015 | Stranczl | G04B 17/32 368/177 |
| 2015/0331392 | A1* | 11/2015 | Ruefenacht | G04B 19/25 368/185 |
| 2016/0062314 | A1 | 3/2016 | Graf et al. | |
| 2017/0269552 | A1* | 9/2017 | Graf | G04B 18/06 |

FOREIGN PATENT DOCUMENTS

| | | | |
|---|---|---|---|
| CH | 710 017 | A2 | 2/2016 |
| CH | 711 766 | A2 | 5/2017 |
| CN | 101840194 | A | 9/2010 |
| CN | 206178347 | U | 5/2017 |
| CN | 105388743 | A | 3/2019 |
| CN | 109426125 | A | 3/2019 |
| FR | 3 043 801 | B3 | 1/2018 |
| JP | 2016-45209 | A | 4/2016 |
| RU | 2017 110 089 | A | 10/2018 |

OTHER PUBLICATIONS

Indian Office Action dated Nov. 5, 2021 in Indian Patent Application No. 202044018956, 5 pages.

Combine Russian Federation Office Action and Search Report dated Oct. 29, 2020 in Russian Federation Patent Application No. 2020115006/28(024918) (with English translation), 14 pages.

Notice of Reason for Refusal dated May 18, 2021 in Japanese Patent Application No. 2020-068141 (with English language translation), 11 pages.

Combined Chinese Office Action and Search Report dated Mar. 24, 2021 in corresponding Chinese Patent Application No. 202010377677.2 (with English Translation of Category of Cited Documents), 10 pages.

* cited by examiner

TIMEPIECE BALANCE

CROSS-REFERENCE TO RELATED APPLICATION

This application claims priority to European Patent Application No. 19173069.6 filed on May 7, 2019, the entire disclosure of which is hereby incorporated herein by reference.

FIELD OF THE INVENTION

The invention relates to a balance for a horological movement, including rigid parts constituted by a hub defining the pivot axis of the balance, a felloe, and at least one arm connecting the felloe to the hub, and including at least one maintaining organ for receiving and gripping in position a rod of an inertia-block.

The invention relates to the field of timepiece oscillators, and more particularly the field of balances including means for inertia setting or/and balancing.

BACKGROUND OF THE INVENTION

Numerous embodiments of balances with inertia setting or/and balancing means are known. In particular, balances with inertia-blocks which are screwed or driven into implantations of the felloe of a balance are known. Some embodiments have attempted to ensure maintaining inertia-blocks by gripping. Document CH 705 238 which discloses a balance including at least one slot for receiving and gripping in position a rod of an inertia-block is thus known, the slot being delimited by, on the one hand, a part called rigid part of the balance, and on the other hand an elastic arm permanently returned towards said rigid part of said balance delimiting said slot to maintain the inertia-block.

When inserting the inertia-blocks, the elastic arm undergoes significant plastic deformations due to its spreading. These plastic deformations can then cause defects in the material, such as cracks. This can therefore affect the reliability of the balance, or even deteriorate it, the inertia-block being able to no longer be maintained correctly by the elastic arm and to dislodge.

SUMMARY OF THE INVENTION

In particular, the invention has the purpose of overcoming the various disadvantages of these known techniques.

More specifically, a purpose of the invention is to provide a balance allowing to obtain better maintenance of the inertia-blocks with an elastic arm capable of remaining within stress levels not exceeding its elastic limit and thus minimising the risk of defects.

Another purpose of the invention is to provide a balance with an elastic arm having a sufficiently rigid geometry and allowing a sufficient pressing force to allow the inertia-block to be maintained in place regardless of the type of shock that the watch undergoes.

These purposes, as well as others which will appear more clearly hereinafter, are achieved according to the invention using a balance for a horological movement according to claim 1.

In accordance with other advantageous variants of the invention:

- the elastic arm is shaped to remain below a plastic deformation threshold of 0.3% at the bottom of the housing during a substantially vertical elevation of the elastic arm relative to the rigid part of the balance to place the rod of the inertia-block;
- the housing is substantially ovoid in shape with an entrance defined by the slot and a bottom, the bottom of the housing having dimensions greater than the entrance of the housing;
- the elastic arm provides a retaining force of at least 0.7N when the inertia-block is mounted;
- the rigid part comprises a notch for positioning the inertia-block, the width of the opening being less than the diameter of the rod of the inertia-block;
- the elastic arm is integral with the felloe;
- the elastic arm is integral with the hub;
- the at least one elastic arm is made in one piece with the balance;
- the balance comprises several elastic arms, the elastic arms being disposed in a central symmetry having for centre that of the balance.

The invention also relates to a horological movement comprising a balance-spring oscillator system according to the invention.

The invention also relates to a timepiece comprising a horological movement in accordance with the invention.

The invention also relates to a method for mounting an inertia-block on a balance in accordance with the invention.

Thus, the object of the present invention, by its different functional and structural aspects described above, allows obtaining a more robust balance in particular thanks to a better distribution of the stresses. In addition, the elastic arm allows good holding of the inertia-block thanks to its particular geometry which allows increasing the volume of material under stress and storing more elastic energy.

BRIEF DESCRIPTION OF THE DRAWINGS

Other features and advantages of the invention will appear more clearly upon reading the following description of a particular embodiment of the invention, given as a simple illustrative and non-limiting example, and of the appended figures, among which.

DETAILED DESCRIPTION OF PREFERRED EMBODIMENTS

Figure 1:
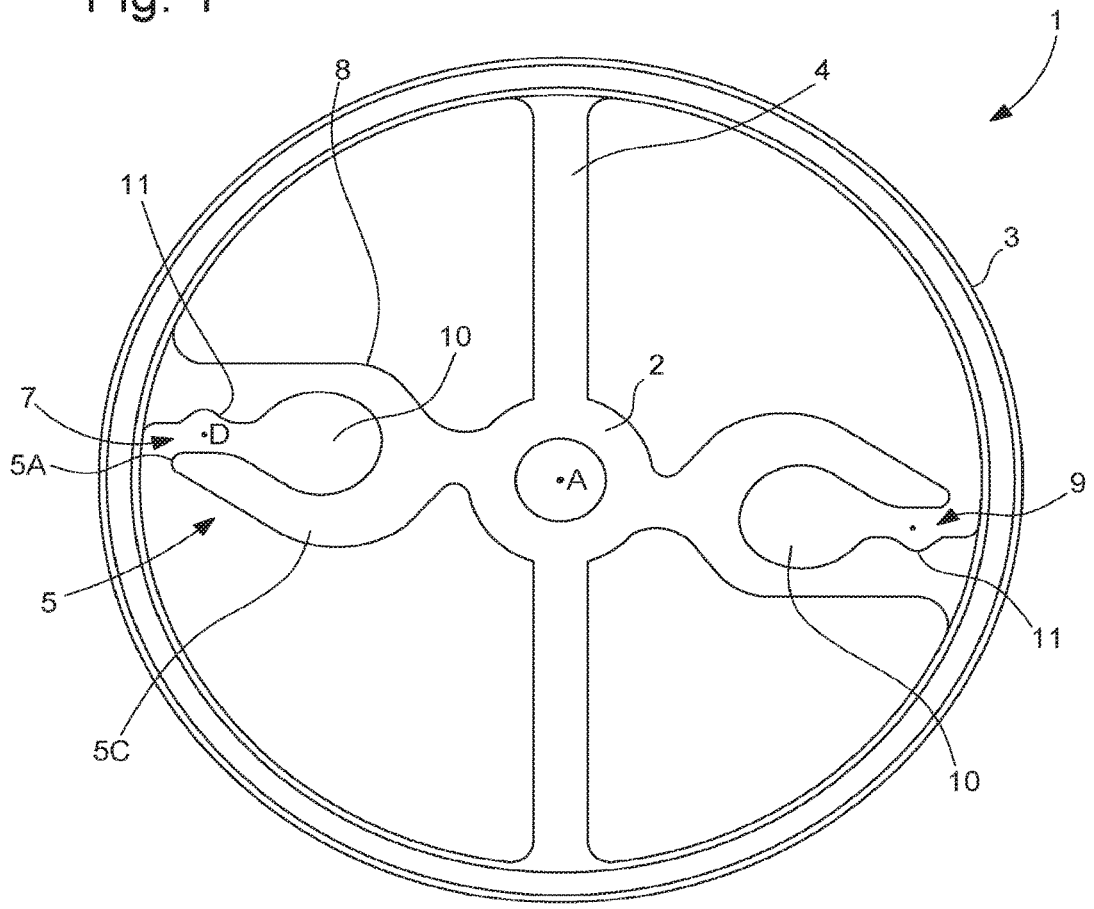
FIGS. 1, 2*a* and 2*b* are respectively top views and a bottom view of a balance in accordance with the invention according to a first embodiment.
Figure 2A:
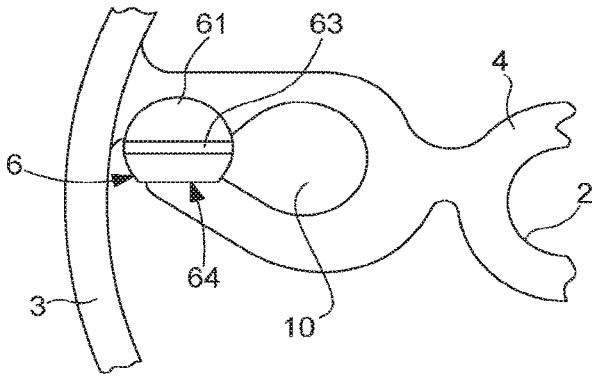
Figure 2B:
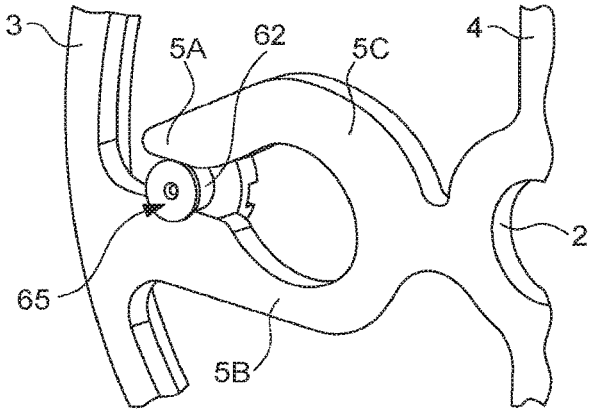

A balance according to an exemplary embodiment will now be described in the following, referring jointly to FIGS. 1*a*, 2*a*, 2*b*, 3, 4*a* and 4*b*.

The invention relates to a balance 1 for a horological movement. The balance comprising rigid parts constituted by a hub 2, the centre of which defines the pivot axis A of the balance 1, a felloe 3, and at least one arm 4 connecting the felloe 3 to the hub 2.

According to the needs of the person skilled in the art, the balance is made of copper, or a copper alloy such as nickel silver. The balance can also be made of aluminium, an aluminium alloy, titanium or titanium alloy, gold or gold alloy, platinum or platinum alloy.

The balance 1 also comprises at least one elastic arm 5 comprising a first end 5B integral with a rigid part of said balance 1, and a second distal end 5A which is free relative to said hub 2, to said arm 4, and to said felloe 3 segment, the free end 5A being capable of deforming in the plane of the felloe and clamping an inertia-block 6 on the balance. The balance also has a slot 7 adapted to receive the inertia-block 6, the slot 7 being delimited on the one hand by the free end 5A of the elastic arm, and on the other hand by a rigid wall 8 integral with the felloe and the hub. The slot 7 has an opening 9 allowing the end 5A of the elastic arm to displace perpendicularly relative to the rigid wall 8 and to be in contact with the inertia-block 6 to clamp it against said rigid wall when this inertia-block is placed in the slot. Advantageously, the slot 7 opens into a housing 10 and comprises a notch 11 for precisely positioning the inertia-block 6 and keeping it in place. The width of the opening 9 is provided less than the diameter of the inertia-block or the rod of the inertia-block to maintain the inertia-block in place.

The inertia-block 6 includes a head 61 including a setting profile 63 arranged to cooperate with a tool. The inertia-block 6 may comprise a rod 62 which extends this head 61, which is of a diameter larger than that of the slot 7.

In the example illustrated in the figures, the inertia-block 6 is equipped with a foot 65, which the rod 62 then connects to the head 61, the latter and the foot 65 then both having a diameter larger than that of the rod 62, so as to limit the travel of the inertia-block 6 at the elastic arm 5, in a direction parallel to the pivot axis D, or even to immobilise it in this direction.

The rod 62 extends along an axis passing through the centre of the inertia-block 6, once gripped in the clamping organ 5, the inertia-block is angularly orientable around this axis by means of a tool on the setting profile 63. The inertia-block 6 includes an unbalance around this axis, which results for example from a flat section 64 formed on the head 61, as visible in FIG. 2*a*.

When the inertia-block 6 is placed in the notch 11 of the opening 9, the free end 5A of the elastic arm 5 displaces substantially perpendicular to the general direction of the spoke connecting the attachment of the rigid arm to the hub and to the felloe relative to the rigid wall 8.

According to the invention, the elastic arm 5 forms a housing 10 delimited by a wall 5B, the body 5C of the elastic arm is arranged to elastically deform during assembly of the inertia-block 6 to the balance, the free end 5A of the elastic arm 5 being capable of displacing substantially perpendicularly, in the plane of the felloe, relative to the rigid wall 8. In the present case, the body 5C of the elastic arm can be considered as an embedded beam of a non-constant section stressed in bending, the body 5C therefore undergoes very little plastic deformation and the lower part of the wall 5B undergoes almost none.

According to the tests carried out by the inventors, the elastic arm 5 only undergoes 0.3% of plastic deformations while the solution used in the prior art undergoes 2% of plastic deformations. The solution used therefore allows reducing the stresses undergone by the elastic arm 5 during the placement of the inertia-block 6.

The dimensions and geometry of the elastic arm 5 are determined to obtain a minimum desired holding force of the inertia-block, the holding force obtained by the elastic arm being at least 0.7N.

Figure 3:
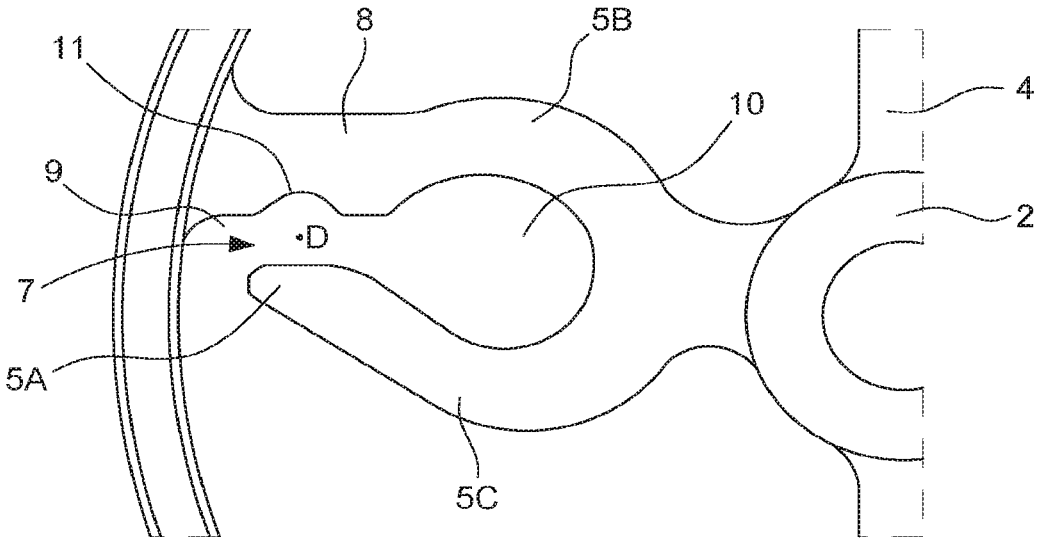
FIG. 3 is a detailed view of an elastic organ for clamping a balance in accordance with the invention according to a first embodiment.

Advantageously, the section of the body of the elastic arm varies, its section changing so as to increase the material under stress and to store therein the maximum possible elastic energy. As shown in FIG. 3, the body 5C has a non-constant section, a part of the body having a locally greater thickness compared to the rest of the body. Such a configuration allows having more material under stress and therefore storing more energy and thus restoring a good holding force on the inertia-block 6. For example, the thickness of the body 5C can be provided to be increasing from its free end to its connection at the hub.

Likewise, the length and the width of the deformable portion 5C are determined to remain below a stress level in order to avoid a plastic deformation. The dimensions of the elastic arm 5 allow storing a large elastic energy resulting from the deformation of the arm, the deformation energy being restored in the form of a maintaining force on the rod of the inertia-block clamped by the elastic arm 5, which ensures its holding by force and by torque in the notch 11.

It will also be noted that the housing 10 formed by the elastic arm 5 has a relatively large radius at the bottom of the curvature, this particular shape is determined to obtain a better distribution of the stresses during the assembly of the inertia-block 6, the stresses being distributed over a much larger surface area compared to the prior art, this allows avoiding embrittlement of the structure at the bottom of the curvature. Indeed, in the prior art, the radius at the bottom of the curvature of the maintaining organ is much smaller, which implies a very localised distribution of the stresses, the formation of microcracks at this location, and therefore a progressive reduction in the maintaining force over time.

As shown in the figures, the housing 10 is substantially ovoid in shape with an entrance defined by the slot 7 and a bottom, the bottom of the housing having dimensions greater than the entrance of the housing.

The invention allows, by the particular geometry of the elastic arm 5, obtaining a satisfactory retaining force of the inertia-block and to eliminate the formation of embrittled areas when the arm is displaced to place the inertia-block 6. It appears that the amount of material under stress is decisive for exerting a satisfactory maintaining force on the inertia-block (According to Clapeyron's formula, the elastic energy stored in the material body is equal to the work of all the applied forces $W=\frac{1}{2}\Sigma_i^n \vec{Fi}\,\vec{\Delta di}$).

The ideal solution would therefore be to increase the amount of material under stress as much as possible so that the elastic arm restores a greater maintaining force. However, such an option implies a larger bulk of the elastic arms, which would substantially modify the inertia of the balance and would complicate the mounting of the latter, in particular the pinning up to the stud.

In a first preferred embodiment, as visible in FIGS. 1, 2*a*, 2*b* and 3, the body 5C of the at least one elastic arm 5 is integral with the hub 2. This first embodiment is advantageous because the inertia-block 6 can be placed beforehand in the housing 10 before displacing it laterally in the slot 7 towards the notch 11, and there is therefore no longer any need to mechanically spread the arm to place the inertia-block 6 therein, which reduces the stresses exerted on the elastic arm 5 by a minimum spreading just sufficient to slide the rod therein.

The invention also relates to a method for mounting an inertia-block on a balance as previously described. The assembly method according to the invention comprises the following steps:

a) placing the balance 1 on a support and maintaining it in place;

b) placing the inertia-block 6 at the housing 10 so that the foot 65 rests in the housing, the foot 65 being positioned in alignment with the slot 7;

c) displacing the inertia-block 6 in a rectilinear direction towards the slot 7 to house the foot 65 in the notch 11.

The method may comprise an optional step subsequently to step c) during which the inertia-block 6 is finely positioned so that the head of the inertia-block is in contact with the upper face of the arm 5 and the upper face of the rigid wall 8.

The invention also relates to a balance 1 which includes a plurality of maintaining organs 5, each being arranged to receive at least one inertia-block 6.

The invention also relates to a horological movement including at least one such balance 1 as described above.

The invention also relates to a timepiece including at least one such movement, and which is preferably a watch.

The invention claimed is:

1. A balance for a horological movement, comprising:

rigid parts constituted by a hub defining the pivot axis of said balance, at least one felloe segment, at least one arm connecting said at least one felloe segment to said hub, and including at least one slot for receiving and gripping in position an inertia-block, said at least one slot opening into a housing delimited by a rigid part of said balance and an elastic arm, the elastic arm including a first end integral with a rigid part of said balance and a second distal end which is free relative to said hub, to said arm, and to said felloe segment, wherein said elastic arm has a body of a non-constant section, a part of the body having a greater thickness than the rest of the elastic arm so as to have a larger volume of material under stress and store a maximum of elastic energy, and wherein said housing is substantially ovoid in shape with an entrance defined by the slot and a bottom, the bottom of the housing having dimensions greater than the entrance of the housing.

2. The balance according to claim 1, wherein the elastic arm is shaped to remain below a plastic deformation threshold of 0.3% at the bottom of the housing during a substantially vertical elevation of the elastic arm relative to the rigid part of the balance to place a rod of the inertia-block.

3. The balance according to claim 1, wherein the elastic arm provides a retaining force of at least 0.7N when the inertia-block is mounted.

4. The balance according to claim 1, wherein said rigid part comprises a notch for positioning the inertia-block, the width of an opening of the slot being less than the diameter of a rod the inertia-block.

5. The balance according to claim 1, wherein the elastic arm is integral with the hub.

6. The balance according to claim 1, wherein said at least one elastic clamping organ is made in one piece with the balance.

7. The balance according to claim 1, further comprising several elastic arms, the elastic arms being disposed in a central symmetry having for centre that of the balance.

8. A horological movement comprising at least one balance according to claim 1.

9. A timepiece comprising at least one movement according to claim 8, wherein said timepiece is a watch.

10. A method for mounting an inertia-block on a balance according to claim 1, the mounting method comprising the following steps:

a) placing the balance on a support and maintaining it in place;

b) placing the inertia-block at the housing so that a foot of the inertia-block rests in the housing, the foot being positioned in alignment with the slot;

c) displacing the inertia-block in a rectilinear direction towards the slot to house the foot in the notch, the foot of the inertia-block spreading the elastic arm during its displacement.

11. The balance according to claim 1, wherein said balance is made of copper or a copper alloy.

12. The balance according to claim 1, wherein said second distal end is configured to deform in a plane of said felloe segment.

13. The balance according to claim 1, wherein said inertia-block includes a head, a foot, and a rod that connects the head to the foot.

14. The balance according to claim 13, wherein a diameter of the head and a diameter of the foot are larger than a diameter of the rod that connects the head to the foot.

15. The balance according to claim 13, wherein said rod extends along an axis passing through a center of said inertia-block.

16. The balance according to claim 15, wherein said axis passing through the center of said inertia-block is parallel to the pivot axis of said balance.

17. The balance according to claim 13, wherein said head includes a flat section.

* * * * *